US005257009A

United States Patent [19]

Narlow

[11] Patent Number: 5,257,009

[45] Date of Patent: Oct. 26, 1993

[54] RERADIATING EAS TAG WITH VOLTAGE DEPENDENT CAPACITANCE TO PROVIDE TAG ACTIVATION AND DEACTIVATION

[75] Inventor: Doug Narlow, Coral Springs, Fla.

[73] Assignee: Sensormatic Electronics Corporation, Deerfield Beach, Fla.

[21] Appl. No.: 749,578

[22] Filed: Aug. 26, 1991

[51] Int. Cl.[5] ..... G08B 13/18

[52] U.S. Cl. ..... 340/572

[58] Field of Search ..... 340/572

[56] References Cited

U.S. PATENT DOCUMENTS

| | | | |
|---|---|---|---|
| 3,754,226 | 8/1973 | Fearon | 340/572 |
| 3,781,661 | 12/1973 | Trikilis | 340/572 |
| 4,021,705 | 5/1977 | Lictblau | 340/572 |
| 4,063,229 | 12/1977 | Welsh et al. | 340/571 |
| 4,158,434 | 6/1979 | Peterson | 235/372 |
| 4,302,846 | 11/1981 | Stephen et al. | 340/572 |
| 4,308,530 | 12/1981 | Kip et al. | 340/572 |
| 4,318,090 | 3/1982 | Narlow et al. | 340/572 |
| 4,549,186 | 10/1985 | Gross et al. | 343/748 |
| 4,555,414 | 11/1985 | Hoover et al. | 427/43.1 |
| 4,583,099 | 4/1986 | Reilly et al. | 343/895 |
| 4,736,207 | 4/1988 | Siikarla et al. | 343/895 |
| 5,099,225 | 3/1992 | Narlow et al. | 340/572 |
| 5,111,186 | 5/1992 | Narlow et al. | 340/572 |

*Primary Examiner*—Glen R. Swann, III

*Attorney, Agent, or Firm*—Robin, Blecker, Daley & Driscoll

[57] ABSTRACT

A tag for an electronic article surveillance system which includes a circuit means for reradiating a predetermined tag signal and voltage dependent means in circuit with the circuit means. The voltage dependent means has a capacitance which can be varied with a change in voltage to selectively enable the circuit means and disable the circuit means from being able to reradiate the predetermined tag signal.

39 Claims, 2 Drawing Sheets

RERADIATING EAS TAG WITH VOLTAGE DEPENDENT CAPACITANCE TO PROVIDE TAG ACTIVATION AND DEACTIVATION

BACKGROUND OF THE INVENTION

This invention relates to electronic article surveillance systems and, in particular, to tags for use in such systems.

One form of tag employed in present electronic article surveillance systems utilizes a circuit which is arranged to receive one or more signals at one or more preselected frequencies and, in response thereto, reradiate a desired or predetermined tag signal at a frequency related to the received one or more frequencies. In some systems of this type, the received signal is at a single high frequency and the predetermined tag signal which is reradiated is at a harmonic of that frequency. In other systems, two high frequency signals are received and the reradiated tag signal includes a signal whose frequency is at the sum of the two received frequencies. In yet other types of systems, one received signal is at a high frequency and another received signal is at a low frequency and the reradiated tag signal comprises a signal at the higher frequency modulated by a signal at the lower frequency. In these types of systems, the tag circuit usually includes a non-linear element such as, for example, a diode, for establishing the reradiated tag signal.

When using the above-described tags in an electronic article surveillance system, a transmitter transmits the signals at the one or more preselected frequencies into a surveillance zone. When a tag passes through the surveillance zone, the tag receives the signals and develops the reradiated predetermined tag signal. A receiver of the system is tuned to a predetermined frequency which depends upon the character of the reradiated tag signal (i.e., whether it is a harmonic of the received signal, or at the sum frequency of the received signals or a modulation of the received signals). The receiver, upon detection of the reradiated tag signal, then activates various alarms, or generates other appropriate signals, to indicate the presence of the tag and, therefore, the article in the zone.

Since detection of the tag is based upon the receiver detecting the reradiated predetermined tag signal, changing the tag circuit to prevent reradiation of this signal effectively deactivates the tag. In prior tags of the present type, a variety of techniques for accomplishing this have been used.

In U.S. Pat. No. 4,063,229, issued on Dec. 13, 1977, to John Welsh and Richard N. Vaughn for "Article Surveillance", and assigned to the same assignee hereof, the disclosed tag is deactivated by altering the semiconductor diode used to establish the reradiated tag signal. In this case, to deactivate the tag, the semiconductor diode is burnt out by a relatively high power RF field which is inductively coupled to the tag. In U.S. Pat. No. 4,021,705, issued May, 3, 1977, to George Jay Lichtblau for "Resonant Tag Circuits Having One or More Fusible Links', there is described a tag whose tag circuit is altered via one or more fusible links to deactivate the tag. Each fusible link is able to be fused by a radiated high energy RF field of a predetermined frequency. The fusing of a fusible link changes the value of the inductors of the tag circuit, thereby changing its resonant frequency from that of the transmitted signal, whereby the tag is deactivated.

Both of the aforesaid deactivation techniques require the use of a high energy RF field which may not be desirable in many surveillance system applications. In U.S. Pat. No. 4,318,090, issued Mar. 2, 1982, to Douglas A. Narlow and Eugene Stevens for "Apparatus For Deactivating A Surveillance Tag", and also assigned to the same assignee hereof, there is described a wand like probe which can be placed in contact with terminals of a tag to deactivate the tag. The wand applies a low energy current through the diode of the tag circuit, thereby destroying the unidirectional characteristics of the diode and preventing the diode from establishing a reradiated tag signal. While the wand alleviates the need to use a high energy RF field, the wand cannot be used to remotely deactivate the tag.

A further limitation of the above described deactivatable tags is that they are not capable of being restored to an active state after being deactivated. Therefore, a tag, upon deactivation, may not be used again.

It is, therefore, a primary object of the present invention to provide an improved tag of the above-described character.

It is further object of the present invention to provide a tag that can be remotely deactivated by a low energy field.

SUMMARY OF THE INVENTION

In accordance with the principles of the present invention, the above and other objectives are realized in a tag of the above-described type in which the circuit means of the tag can be selectively changed so as to inhibit reradiation of a predetermined tag signal. More particularly, the tag is provided with a voltage dependent capacitance means whose capacitance can be varied by a voltage change so as to selectively enable the tag circuit means and disable the tag circuit means from being able to reradiate the predetermined tag signal.

In the embodiment of the invention to be disclosed hereinafter, the capacitance means comprises a capacitor having a first capacitance value for voltages equal to or exceeding a first threshold voltage and a second capacitance value for voltages equal to or less than a second threshold voltage. When the capacitance value is at the first value, the effect on the circuit means is such that the tag is able to reradiate the predetermined tag signal and when the capacitance is at its second value, the effect on the circuit means is such that the tag is unable to reradiate such signal. Accordingly, by changing the voltage applied to the capacitance means, the tag can be made to reradiate or not reradiate the tag signal and, hence, take on an activated or deactivated state.

Additionally, in the disclosed embodiment, the capacitor is caused to operate in this fashion by including a ferroelectric dielectric in the capacitor. This dielectric is selected to exhibit a first dielectric constant for voltages equal to or above the first threshold voltage and a second dielectric constant for voltages equal to or below the second threshold voltage. This results in the capacitance means exhibiting the first and second capacitance values.

Also, in the disclosed embodiment, the circuit means includes a diode structure and the capacitance means is formed as an integrated unit with the diode structure.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
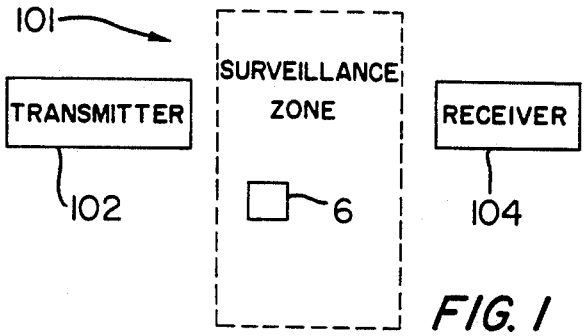
FIG. 1 PRIOR ART
FIG. 1 shows an electronic article surveillance system employing a conventional type of tag which operates by reradiating a predetermined tag signal.

Referring now to FIG. 1, there is shown an electronic article surveillance system 101 which utilizes a tag 6 of the type described in U.S. Pat. No. 4,736,207 issued Apr. 5, 1988, for "Tag Device and Method For Electronic Article Surveillance", and assigned to the same assignee hereof. With this type of tag, the tag circuit is adapted to receive both a high frequency transmitted signal, typically at microwave frequencies, and a low frequency transmitted signal, typically at 100 KHz frequency.

These signals are propagated by the system transmitter 102 into a surveillance zone 103. The tag circuit establishes from these received signals a tag signal comprised of a signal at the high frequency modulated by a signal at the low frequency. This tag signal is reradiated by the tag circuit and detected at the system receiver 104 by sensing one of the sidebands of the signal.

It should be noted that while the tag of the '207 patent has been used to illustrate the present invention, the principles of the invention are intended to apply as well to other like types of tags mentioned above wherein the tag circuit establishes and reradiates a predetermined tag signal.

Figure 2:
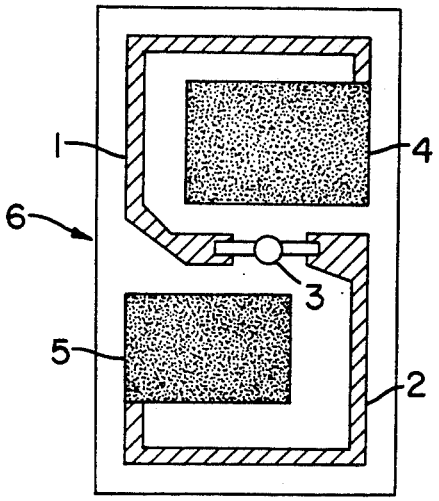
FIG. 2 PRIOR ART
FIG. 2 shows the tag of FIG. 1 in greater detail.

Looking now at the circuit of the tag 6 shown in greater detail in FIG. 2, it comprises first circuit elements generally designated as 1 and 2, extending oppositely from the center of the tag. A diode 3 is connected in electrical series circuit with first circuit elements 1 and 2. Second circuit elements designated as 4 and 5 are electrically continuous with terminal portions of the first circuit elements 1 and 2.

First circuit elements 1 and 2 have a configuration selected such as to render the full series circuit comprising second circuit elements 4 and 5, diode 3 and first circuit elements 1 and 2, resonant at the frequency $f_m$ of the high frequency transmitted signal. On the other hand, the second circuit elements 4 and 5 are dedicated or allocated, within the constraints of tag 6, to the reception of the low frequency transmitted signal which is likewise subject to the elements of the aforesaid series circuit.

Figure 2A:
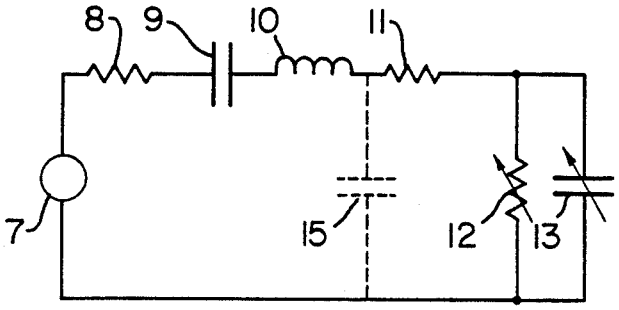
FIGS. 2A and 2C show in solid line equivalent circuits for the tag of FIG. 1 and in dotted line modifications to the equivalent circuits resulting from modifying the tag of FIG. 1 in accordance with the invention and as shown in FIG. 3.

The equivalent circuit of FIG. 2A represents the tag 6 of FIGS. 1 and 2 generally in response to the receipt of the high frequency transmitted signal at the high frequency $f_m$, as represented by signal generator 7. First circuit elements 1 and 2, and second circuit elements 4 and 5 are represented by an equivalent resistor 8, equivalent capacitor 9 and equivalent inductor 12. Resistance 11 represents the diode 3 substrate resistance and is substantial at the frequency $f_m$, due to low impedance levels on each side of the diode 3. Variable resistance 12 represents the dynamic resistance of the diode 3 and is a function of the applied voltage. Capacitance 13 represents the dynamic capacitance of the diode 3 and is also a function of the applied voltage.

Figure 2B:
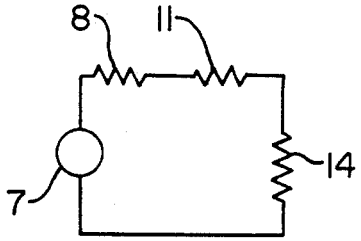
FIG. 2B PRIOR ART
FIG. 2B shows a further equivalent circuit of the tag of FIG. 1.

FIG. 2B is a simplified version of the FIG. 2A equivalent circuit when the high frequency signal is received, resistance 14 being the equivalent series component of parallel resistance 12. As is seen, the total reactance of capacitances 9 and 13 and inductance 10, at the high frequency $f_m$ cancel one another and the tag 6 is resonant and resistive at such frequency.

Figure 2C:
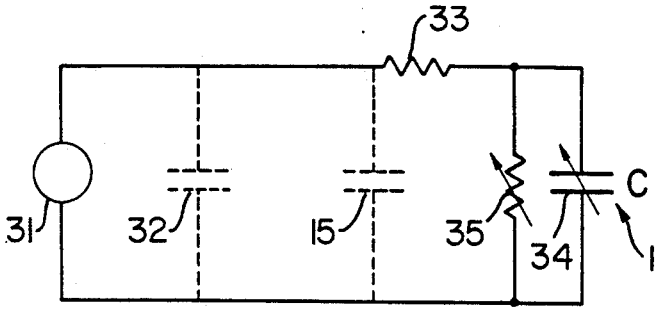

FIG. 2C shows the equivalent circuit of the tag 6 of FIGS. 1 and 2 generally in response to receipt of the low frequency signal, represented by the signal generator 31, and resulting from the voltage of the second circuit elements 4 and 5 impressed across the tag. At the lower frequency, the first and second circuit elements, which also comprise a dipole antenna, define essentially a pure capacitor 32. The diode 3 has a small substrate series resistance 33 which is insignificant at the low frequency. Diode capacitance 34, which is a function of applied voltage, is shown as variable. Resistance 35 is the diode resistance, also a function of applied voltage, and hence is also shown as variable.

Figure 3:
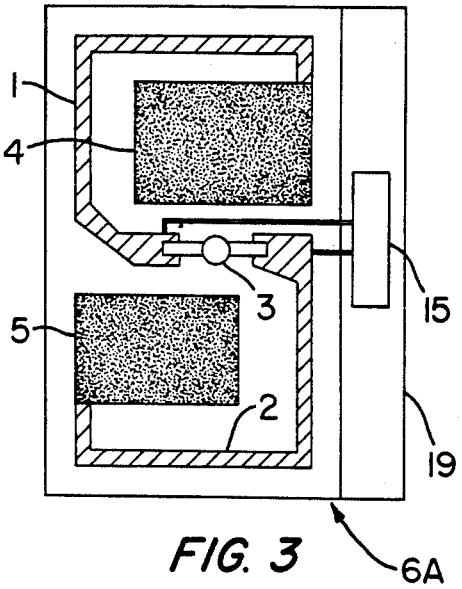
FIG. 3 shows the tag of FIG. 1 modified to include with the diode of the tag a capacitor in accordance with the principles of the present invention.

FIG. 3 shows the tag 6 of FIG. 1 modified in accordance with the principles of the present invention to form the tag 6A. In the FIG. 3 modification, a second voltage dependent or variable capacitor 15 is added to the tag. In the case shown, the capacitor 15 is formed as an integrated unit with the diode structure 3. In particular, the capacitor 15 is layered onto the diode and comprises three layers. Two outer layers form two electrodes for the capacitor and an inner layer forms the capacitor dielectric. The layers can be added to the diode structure 3 by well known semiconductor fabrication processes.

The capacitor 15 may be formed or added to the diode 3 so as to be electrically in series or parallel with the diode. In the particular case shown, the capacitor has been added in parallel with the diode.

Figure 4:
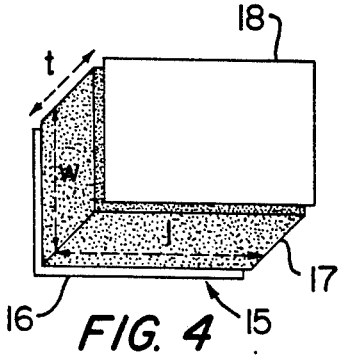
FIG. 4 shows in greater detail the capacitor of the tag of FIG. 3.

FIG. 4 shows the capacitor 15 of the integrated diode and capacitor structure in greater detail. As shown, the capacitor is formed by two parallel conductive layers 16 and 18 which sandwich a dielectric layer 17. A first approximation of the capacitance of the capacitor 15 is based upon the equation:

$$C = \frac{K \cdot t_o \cdot A_d}{t} \quad (1)$$

Where:

d = area of the conductive plate.

K=the dielectric constant of the dielectric
T=thickness of the dielectric
$t_o$=permittivity constant=$8.85\times10^{-12}$F/m.

In accord wit the invention, the dielectric 17 of the capacitor 15 is selected to have a dielectric constant which varies with voltage and, in particular, which, preferably, exhibits dielectric constant K1 for voltages increasing above a first threshold voltage and a second dielectric constant K2 for voltage decreasing below a second threshold voltage. Usable dielectric materials having such a dielectric characteristic are ferroelectric materials. A particular advantageous ferroelectric material is lead zirconium titanate (PZT), since the dielectric constant of PZT changes upon the applicant of relative low voltages (i.e., 2–10 volts) across the dielectric. Other usable ferroelectric materials are potassium nitrate, bismuth nitrate and lead germanate.

Figure 5:
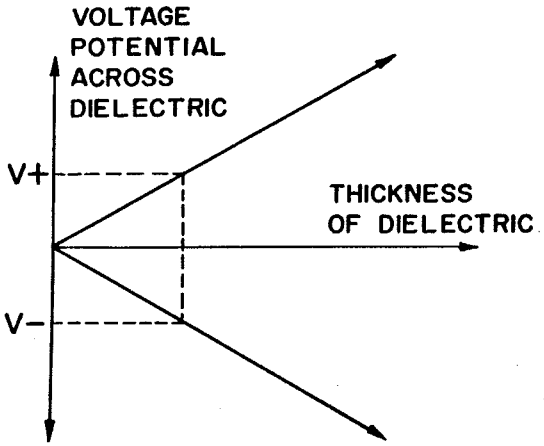
FIG. 5 shows the threshold voltages as a function of thickness for dielectrics usable in the capacitor of the tag of FIG. 3.

FIG. 5 is a graph illustrating the positive and negative voltage potential values at which the dielectric constant of the dielectric 17 switches as a function of the dielectric thickness t. In FIG. 5, the abscissa represents the thickness t and the ordinate represents the threshold voltage V required across the dielectric 17 to switch its dielectric constant. As shown, for each dielectric thickness t, a threshold voltage V+is required to ensure that the dielectric constant is at a first value. Similarly, a negative threshold voltage V− is required to ensure that the dielectric constant is at a second value. For PZT of thickness 3000Å, K1=600 and K2=1200, and V+,V−=+5 volts, respectively.

Figure 6:
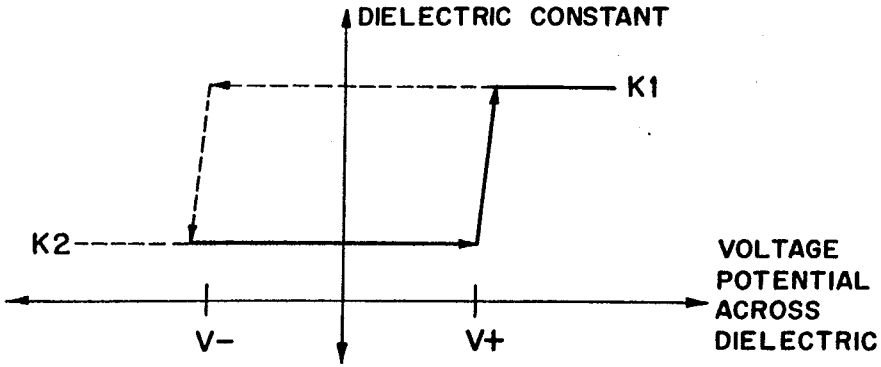
FIG. 6 shows the dielectric constant as a function of the voltage for the dielectric of the capacitor of the tag of FIG. 3.

FIG. 6 is a graph illustrating the voltage across the capacitor 15 versus the dielectric constant value for the dielectric 17. Starting with a voltage potential exceeding V+, the dielectric constant is at a value K1. As the voltage is reduced, the dielectric constant remains at K1 until a negative voltage V− is reached. Upon reaching V−, the dielectric constant switches substantially stepwise to a lower value K2. For all voltages below V−, the dielectric constant remains at K2. Thereafter, when increasing the voltage, the dielectric constant remains at K2 until voltage reaches threshold V+, at which time the dielectric constant switches again substantially stepwise to the higher value K1.

Since the capacitance of capacitor 15 is linearly related to the dielectric constant of the dielectric 17, the capacitance will follow a similar hysteresis type characteristic as that shown in FIG. 6 for the dielectric 17. The capacitance will thus switch between a first capacitance C1 and a second capacitance C2 at the thresholds V+ and V−.

The presence of the capacitor 15 in the tag circuit and the ability to switch the capacitance value from C1 to C2 permits the low frequency circuit of the tag and/or the high frequency circuit of the tag to be altered such that for one capacitance value (e.g., C1) the tag is able to reradiate the predetermined tag signal and for the other capacitance value (e.g., C2) the tag is unable to reradiate this signal. More particularly, the position of the capacitor 15 in the high and low frequency equivalent circuits of FIGS. 2A and 2C is shown by the dotted line capacitor 15 depicted in these figures.

As can be appreciated from viewing the low frequency circuit of FIG. 2C, the capacitor 15 has a shunting effect on the low frequency signal being coupled by the circuit to its diode components 33–35. Accordingly, the capacitance values C1 and C2 of the capacitor 15 can be selected, in relation to the other components of the tag circuit, such that at these capacitance values the capacitor exhibits a relatively high and relatively low impedance, respectively, at the low frequency.

As a result, at the C1 value of the capacitor 15, the low frequency signal will be negligibly degraded by the capacitor, and when the low frequency signal is then applied to the diode 3 it will result in the predetermined tag signal. On the other hand, at the C2 value of the capacitor 15, the low frequency signal will be significantly degraded by the capacitor and, therefore, when the signal is applied to the diode, the diode will not result in such predetermined tag signal. Hence, by appropriately switching the capacitor 15 between the capacitance values C1 and C2, the tag 6A can be activated and deactivated, due to the different effects of the respective capacitances on the low frequency signal being applied to the diode 3.

By also further selecting the capacitor 15 such that its different capacitance values materially differently affect the high frequency tag circuit of the tag 6A, the effects of the capacitor on the high frequency circuit can be further used to promote activation and deactivation of the tag 6A. More particularly, the capacitor 15 and the tag 6A elements can be selected such that their combined reactance at the capacitance value C1, causes the tag circuit to be resonant at the high frequency $f_m$. The tag circuit and capacitor will thus be non resonant at the frequency $f_m$ when the capacitor 15 is at its other capacitance value C2. Accordingly, by switching the capacitor between the capacitance values C1 and C2, the tag 6A will be changed from being highly responsive to the high frequency signal at resonance to being less responsive to this signal at non-resonance. This, in turn, will further enable reradiation of the tag signal at resonance (at the capacitance value C1) when the tag is to be active and disable reradiation of the tag signal at non-resonance (at the capacitance value C2) when the tag is to be deactivated.

It should be noted that, in the above example, the capacitor 15 has been illustrated as affecting both the low and high frequency tag circuits. However, it should be appreciated that the invention can also be practiced by limiting the effects of the capacitor to either one or the other of these circuits, if desired.

With the tag 6A configured in accordance with the above-discussed principles, the tag can be activated by subjecting it to a field which results in a voltage of V+across the capacitor 15 and, therefore, a capacitance value C1 for the capacitor. Deactivating the tag would then require that it be subjected to an applied field of V− to set the capacitor at the value C2.

Figure 7:
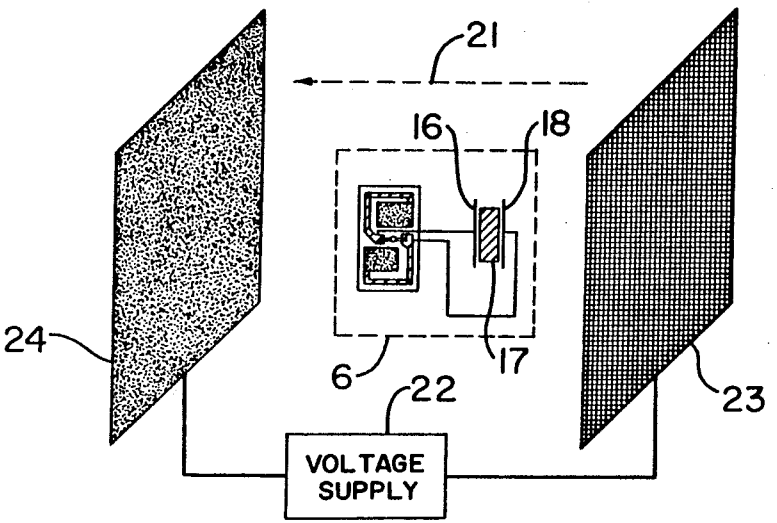
FIGS. 7 and 8 illustrate respective activation and deactivation devices for the tag of FIG. 3.

FIG. 7 illustrates a technique for activating the tag 6A utilizing an electrostatic field 21 formed between plates 23 and 24. Voltage supply 22 applies a positive voltage to plate 23 with respect to the voltage applied to plate 24 When the tag 6A is placed within the electrostatic field 21, a voltage differential is induced across the conductive plates 16 and 18 of the capacitor 15. The conductive plate 18 thus develops a positive voltage with respect to conductive plate 16. By increasing the electrostatic field 21 until the voltage differential reaches the threshold voltage V+discussed above, the dielectric constant of the dielectric 17 switches to K1 and, therefore, the capacitance of the capacitor 15 switches to C1. The tag is thus in its active state, as above-described. Upon removing the tag from the electrostatic field 21, the tag remains active due to the hysteresis characteristic of the dielectric as also discussed previously.

Figure 8:
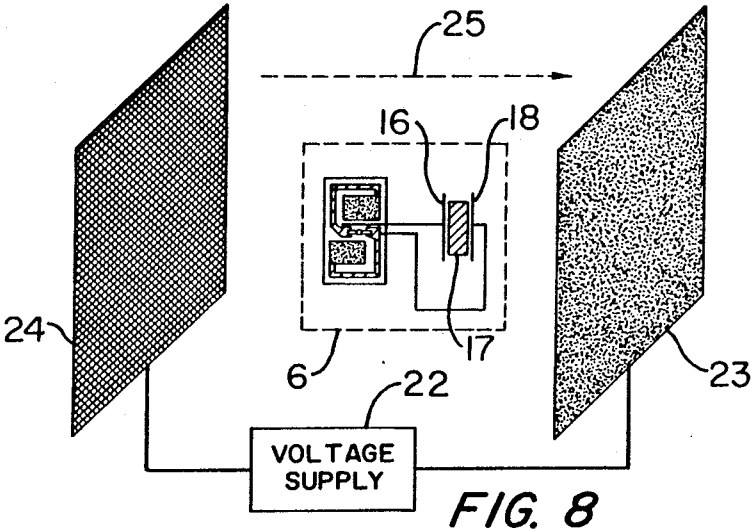

In FIG. 8, tag 6A is deactivated by an electrostatic field 25 formed between plates 23 and 24. In this case voltage supply 22 applies a positive voltage to plate 24 with respect to the voltage applied to plate 23, causing conductive plate 18 to develop a negative voltage with respect to the conductive plate 16. By decreasing the electrostatic field 25 until the voltage differential reaches V−, the dielectric constant switches to K2 and, therefore, the capacitance of the tag switches to C2. The tag is thus deactivated and remains deactivated upon removing the tag from the electrostatic field 25, due to the hysteresis characteristic of the dielectric.

While activation and deactivation of the tag have bee illustrated using an electrostatic field, other types of mechanisms can also be used. Thus, a high voltage pulse of appropriate polarity may be generated and propagated by an antenna to the conductive plates, to provide the threshold voltages.

In all cases it is understood that the above-described arrangements are merely illustrative of the many possible specific embodiments which represent applications of the present invention. Numerous and varied other arrangements can be readily devised in accordance with the principles of the present invention without departing from the spirit and scope of the invention.

What is claimed is:

1. A tag for use in an article surveillance system in which a plurality of signals at a plurality of preselected frequencies are established in a surveillance zone, said plurality of signals including a firs signal at a first frequency and a second signal at a second frequency lower than the first frequency, and an alarm is initiated upon detection of a predetermined tag signal reradiated by the tag at a frequency related to the plurality of preselected frequencies, the tag comprising:

circuit means responsive to said plurality of signals for reradiating said predetermined tag signal, said circuit means being substantially resonant at said first frequency and including: means for receiving said plurality of signals; and means responsive to said receiving means for establishing said predetermined tag signal;

and voltage dependent capacitance means in circuit with said circuit means and having a capacitance which can be switched with a change in voltage to selectively enable said circuit means and disable said circuit means from being able to reradiate said tag signal, said voltage dependent capacitance means being arranged relative to said receiving means and establishing means of said circuit means such that, when said voltage dependent capacitance means is switched to a first capacitance value, said voltage dependent capacitance means inhibits said second signal in said plurality of signals from passing from said receiving means to said establishing means to a significantly lesser degree than when said voltage dependent capacitance means is switched to said second capacitance value, thereby enabling said establishing means to establish said tag signal when said capacitance means is at said first capacitance value and disabling said establishing means for being able to establish said tag signal when said capacitance means is at said second capacitance value.

2. A tag in accordance with claim 1, wherein:

said voltage dependent capacitance means switches to a first capacitance value when voltages equal to or greater than a first threshold voltage are applied to said voltage dependent capacitance means and switches to a second capacitance value when voltages equal to or less than a second threshold voltage are applied to said voltage dependent capacitance means, said first capacitance value resulting in enabling of said circuit means and said second capacitance value disabling said circuit means.

3. A tag in accordance with claim 2, wherein:

said voltage dependent capacitance means includes a dielectric whose dielectric constant switches to a first dielectric constant value when voltages equal to or greater than said first threshold voltage are applied to said voltage dependent capacitance means and switches to a second dielectric constant value when voltages equal to or less than said second threshold voltage are applied to said voltage dependent capacitance means, said first and said second dielectric constants resulting in said first and second capacitance values.

4. A tag in accordance with claim 3 wherein:

said dielectric constant of said dielectric remains at said first dielectric constant value as the voltage applied to said voltage dependent capacitance means decreases from above said first threshold voltage to said second threshold voltage at which said dielectric constant undergoes substantially a step change to said second dielectric constant value;

and said dielectric constant of said dielectric remains at said second dielectric constant value as the voltage applied to said voltage dependent capacitance means increases from below said second threshold value to said first threshold value at which said dielectric constant undergoes substantially a step change to said first dielectric constant value.

5. A tag in accordance with claim 2 wherein:

the capacitance of said voltage dependent capacitance means remains at said first capacitance value as the voltage applied to said voltage dependent capacitance means decreases from above said first threshold voltage to said second threshold voltage at which said capacitance of said voltage dependent capacitance means undergoes substantially a step change to said second capacitance value;

and the capacitance of said voltage dependent capacitance means remains at said second capacitance value as the voltage applied to said capacitance increases from below said second threshold value to said first threshold value at which said capacitance of said voltage dependent capacitance means undergoes substantially a step change to said first capacitance value.

6. A tag in accordance with claim 2 wherein:

said capacitance means is formed as an integrated unit with said circuit means.

7. A tag in accordance with claim 2 wherein:

said voltage dependent capacitance means comprises: a capacitor having a ferroelectric dielectric.

8. A tag in accordance with claim 7, wherein:

said ferroelectric dielectric is one of lead zirconium titanate, potassium nitrate, bismuth nitrate and lead germanate.

9. A tag in accordance with claim 2, wherein:

said enabling of said circuit means corresponds to said tag's being activated and said disabling of said circuit means corresponds to said tag's being deactivated.

10. A tag in accordance with claim 2, wherein:

said circuit means includes non-linear means for establishing said predetermined tag signal;

and said voltage dependent capacitance means is one of in parallel and in series with said non-linear means and is such that when said capacitance means is at said first capacitance value said non-linear means is able to establish said predetermined tag signal and when said capacitance means is at said second capacitance value said non-linear means is unable to establish said predetermined tag signal.

11. A tag in accordance with claim 10 wherein:

said non-linear means is a diode.

12. A tag in accordance with claim 11 wherein:

said diode and voltage dependent capacitance means are formed as an integrated unit.

13. A tag in accordance with claim 12 wherein:

said capacitance means comprises electrode layers sandwiching a dielectric layer, said electrode layers and dielectric layer being layered onto said diode.

14. A tag in accordance with claim 10 wherein:

said non-linear means establishes said predetermined tag signal by forming a signal t said first frequency modulated by a signal at said second frequency.

15. A tag in accordance with claim 14 wherein:

said circuit means and said capacitance means are such that at said first capacitance value of said capacitance means, said circuit means and capacitance means are resonant at said first frequency and, at said second capacitance value of said capacitance means, said capacitance means and circuit means are non resonant at said first frequency.

16. A tag in accordance with claim 2 wherein:

said circuit means and said capacitance means are such that, at said first capacitance value of said capacitance means, said circuit means and capacitance means ar resonant at said first frequency and, at said second value of said capacitance means, said circuit means and capacitance means are non resonant at said first frequency.

17. An article surveillance system for detecting the presence of an article in a surveillance zone, the system comprising:

means for generating a plurality of signals at a plurality of preselected frequencies within said surveillance zone, said plurality of signals including a first signal at a first frequency and a second signal at a second frequency lower than the first frequency;

a tag comprising circuit means responsive to said plurality of signals for reradiating a predetermined tag signal at a frequency related to said plurality of preselected frequencies, said circuit means being substantially resonant at said first frequency and including means for receiving said plurality of signals and means responsive to said receiving means for establishing said predetermined tag signal; and voltage dependent capacitance means in circuit with said circuit means and having a capacitance which can be switched with changes in voltage to selectively enable said circuit means and disable said circuit means for being able to reradiate said tag signal, said voltage dependent capacitance means being arranged relative to said receiving means and establishing means of said circuit means such that, when said voltage dependent capacitance means is switched to a first capacitance value, said voltage dependent capacitance means inhibits the passage of said second signal in said plurality of signals from passing from said receiving means to said establishing means to a significantly lesser degree than when said voltage dependent capacitance means is switched to a second capacitance value, thereby enabling said establishing means to establish said tag signal when said capacitance means is at said first capacitance value and disabling said establishing means from being able to establish said tag signal when said capacitance means is at said second capacitance value; and means for detecting said tag signal reradiated by said tag.

18. An article surveillance system in accordance with claim 17, further comprising:

an alarm responsive to said detecting means.

19. An article surveillance system in accordance with claim 17, wherein:

said voltage dependent capacitance means switches to a first capacitance value when voltages equal to or greater than a first threshold voltage are applied to said voltage dependent capacitance means and switches to a second capacitance value when voltages equal to or less than said second threshold voltage are applied to said voltage dependent capacitance means; said first capacitance value resulting in enabling said circuit means and said second capacitance value resulting in disabling said circuit means.

20. An article surveillance system in accordance with claim 19, further comprising:

means for applying a voltage equal to or greater than said first threshold voltage to said voltage dependent capacitance means; and means for applying a voltage equal to or less than said second threshold voltage to said voltage dependent capacitance means.

21. An article surveillance system in accordance with claim 20, wherein:

said means for applying a voltage equal to or greater than said first threshold voltage and said means for applying a voltage equal to or less than said second threshold voltage include means for applying a static electrostatic field to said tag.

22. An article surveillance system in accordance with claim 20, wherein;

said means for applying a voltage equal to or greater than said first threshold voltage and said means for applying a voltage equal to or less than said second threshold voltage include means for applying a pulsed electrostatic field to said tag.

23. A article surveillance system in accordance with claim 19 wherein:

said voltage dependent capacitance means is formed as an integrated unit with said circuit means.

24. An article surveillance system in accordance with claim 19, wherein:

said voltage dependent capacitance means comprises: a capacitor having a ferroelectric dielectric.

25. An article surveillance system in accordance with claim 24, wherein:

said ferroelectric dielectric is one of lead zirconium titanate, potassium nitrate, bismuth nitrate and lead germanate.

26. An article surveillance system in accordance with claim 19 wherein:

said voltage dependent capacitance means includes a dielectric whose dielectric constant is switched to a first dielectric constant value when voltages equal to or greater than said first threshold voltage are applied to said voltage dependent capacitance means and switches to a second dielectric constant value when voltages equal to or less than said second threshold voltage are applied to said voltage dependent capacitance means, said first and said second dielectric constants resulting in said first and second capacitance values.

27. An article surveillance system in accordance with claim 26 wherein:

said dielectric constant of said dielectric remains at said first dielectric constant value as the voltage applied to said voltage dependent capacitance means decreases from above said first threshold voltage to said second threshold voltage at which said dielectric constant undergoes substantially a step change to said second dielectric constant value;

and said dielectric constant of said dielectric remains at said second dielectric constant value as the voltage applied to said voltage dependent capacitance means increases from below said second threshold value to said first threshold value at which said dielectric constant undergoes substantially a step change to said first dielectric constant value.

28. An article surveillance system in accordance with claim 19 wherein:

said circuit means includes non-linear means for establishing said predetermined tag signal;

and said voltage dependent capacitance means is one of in parallel and in series with said non-linear circuit means and is such that, when said capacitance means is at said first capacitance value, said non-linear circuit means is able to establish said predetermined tag signal and, when said capacitance means is at said second capacitance value, said non-linear means is unable to establish said predetermined tag signal.

29. An article surveillance system in accordance with claim 28 wherein:

said non-linear means is a diode.

30. An article surveillance system in accordance wit claim 29 wherein:

said diode and voltage dependent capacitance means are formed as an integrated unit.

31. An article surveillance system in accordance with claim 30 wherein:

said capacitance means comprises electrode layers sandwiching a dielectric layer, said electrode layers and dielectric layer being layered onto said diode.

32. A article surveillance system in accordance with claim 8 wherein:

said non-linear means establishes said predetermined tag signal by forming a signal at said first frequency modulated by a signal at said second frequency.

33. An article surveillance system in accordance with claim 32 wherein:

said circuit means and said capacitance means are such that, at said first capacitance value of said capacitance means, said circuit means and capacitance means are resonant at said first frequency and, at said second capacitance value of said capacitance means, said capacitance means and circuit means are non resonant at said first frequency.

34. An article surveillance system in accordance with clam 19 wherein:

said circuit means and said capacitance means are such that, at said first capacitance value of said capacitance means, said circuit means and capacitance means are resonant at said first frequency and, at said second value of said capacitance means, said circuit means and capacitance means are non resonant at said first frequency.

35. A method for detecting the presence of an article in a surveillance zone, the method comprising:

generating a plurality of signals at a plurality of preselected frequencies within said surveillance zone, said plurality of signals including a first signal at a firs frequency and a second signal at a second frequency lower than the first frequency;

passing a tag into the surveillance zone, the tag comprising: circuit means responsive to said plurality of signals for reradiating a predetermined tag signal at a frequency related to said plurality of preselected frequencies, said circuit means being substantially resonant at said first frequency and including means for receiving said plurality of signals and means responsive to said receiving means for establishing said predetermined tag signal; and voltage dependent capacitance means in circuit with said circuit means and having a capacitance which can be switched with changes in voltage to selectively enable said circuit means and disable said circuit means for being able to reradiate said tag signal, said voltage dependent capacitance means being arranged relative to said reciting means and establishing means of said circuit means such that, when said voltage dependent capacitance means is switched to a first capacitate value, said voltage dependent capacitance means inhibits said second signal in said plurality of signals from passing from said receiving means to said establishing means to a significantly lesser degree than when said voltage dependent capacitance means is switched to a second capacitance value, thereby enabling said establishing means to establish said tag signal when said capacitance means is at said first capacitance value and disabling said establishing means from being able to establish said tag signal when said capacitance means is at said second capacitance value; and detecting said tag signal reradiated by said tag.

36. A method in accordance with claim 35, wherein:

said voltage dependent capacitance means switches to a first capacitance value when voltages equal to or greater than a first threshold voltage are applied to said voltage dependent capacitance means and switches to a second capacitance value when voltages equal to or less than said second threshold voltage are applied to said voltage dependent capacitance means, said first capacitance value resulting in enabling said circuit means and said second capacitance value resulting in disabling said circuit means.

37. A method in accordance with claim 36 further comprising:

applying a field to said tag to cause the voltage across said capacitance means to be equal to or greater than said first threshold voltage to set said voltage dependent capacitance means at said first capacitance value.

38. A method in accordance with claim 36 further comprising;

applying a field to said tag to cause the voltage across said capacitance means to be equal to or less than said second threshold voltage to set said voltage dependent capacitance means at said second capacitance value.

39. A method in accordance with claim 38 wherein: said voltage dependent capacitance means comprises: a capacitor having a ferroelectric dielectric.

* * * * *

UNITED STATES PATENT AND TRADEMARK OFFICE

CERTIFICATE OF CORRECTION

PATENT NO. : 5,257,009

DATED : October 26, 1993

INVENTOR(S) : Doug Narlow

It is certified that error appears in the above-indentified patent and that said Letters Patent is hereby corrected as shown below:

Col. 2, line 26. After "is" insert -- a --

Col. 4, line 12. Change "12" to -- 10 --

Col. 4, line 68. Change "d=" to -- AD= --

Col. 5, line 12. Change "particular" to -- particularly --

Col. 5, line 14. Change "applicant" to -- application --

Col. 5, line 30. Change "+5" to -- ±5 --

Col. 7, line 30. Change "firs" to -- first --

Col. 9, line 24. Change "t" to -- at --

Col. 9, line 28. After "that" insert -- , --

Col. 9, line 39. Change "ar" to -- are --

Col. 9, line 63. Change "for" to -- from --

Col. 10, line 54. Change "A" to -- An --

Col. 11, line 2. Change "is switched" to -- switches --

Col. 11, line 45. Change "wit" to -- with --

Col. 11, line 56. Change "8" to -- 28 --

Col. 12, line 15. Change "firs" to -- first --

Col. 12, line 31. Change "for" to -- from --

UNITED STATES PATENT AND TRADEMARK OFFICE

CERTIFICATE OF CORRECTION

PATENT NO. : 5,257,009

DATED : October 26, 1993

INVENTOR(S) : Doug Narlow

It is certified that error appears in the above-indentified patent and that said Letters Patent is hereby corrected as shown below:

Col. 12, line 33. Change "reciting" to -- receiving --

Col. 12, line 36. Change "capacitate" to -- capacitance --

Col. 12, line 41. Change "a" to -- said --

Signed and Sealed this

Tenth Day of May, 1994

Bruce Lehman

*Attest:*

BRUCE LEHMAN

*Attesting Officer*

*Commissioner of Patents and Trademarks*